US009022836B2

(12) United States Patent
Bened et al.

(10) Patent No.: US 9,022,836 B2
(45) Date of Patent: May 5, 2015

(54) DRESSING DEVICE FOR A GRINDING WHEEL AND ITS USE IN A CENTRELESS NUCLEAR FUEL PELLET GRINDER

(75) Inventors: José Bened, Remoulins (FR); Hervé Medina, Saint Genies de Comolas (FR)

(73) Assignee: Areva NC, Paris (FR)

( * ) Notice: Subject to any disclaimer, the term of this patent is extended or adjusted under 35 U.S.C. 154(b) by 142 days.

(21) Appl. No.: 13/812,621

(22) PCT Filed: Jul. 25, 2011

(86) PCT No.: PCT/EP2011/062746

§ 371 (c)(1),
(2), (4) Date: Jan. 28, 2013

(87) PCT Pub. No.: WO2012/013633

PCT Pub. Date: Feb. 2, 2012

(65) Prior Publication Data

US 2013/0122789 A1 May 16, 2013

(30) Foreign Application Priority Data

Jul. 27, 2010 (FR) ..... 10 56137

(51) Int. Cl.
*B24B 53/00* (2006.01)
*B24B 53/04* (2012.01)
*B24B 53/12* (2006.01)

(52) U.S. Cl.
CPC ..... *B24B 53/04* (2013.01); *B24B 53/12* (2013.01)

(58) Field of Classification Search
USPC ..... 451/56, 164, 166, 173, 324, 443, 242, 451/246, 254, 258; 125/11.01, 11.04, 125/11.09, 11.18, 11.21
See application file for complete search history.

(56) References Cited

U.S. PATENT DOCUMENTS 2,187,690 A * 1/1940 Martin ..... 125/11.06
2,832,330 A * 4/1958 Hughes ..... 125/11.06
3,122,133 A * 2/1964 Price ..... 125/11.01
3,221,727 A * 12/1965 Pitcl et al. ..... 125/11.01

(Continued)

FOREIGN PATENT DOCUMENTS

DE 31 16 140 A1 11/1982
EP 0 105 626 A2 4/1984

(Continued)

OTHER PUBLICATIONS

International Search Report and Written Opinion in International Application No. PCT/EP2011/062748, mailed Oct. 11, 2011.

(Continued)

*Primary Examiner* — Eileen P. Morgan
(74) *Attorney, Agent, or Firm* — Nixon Peabody LLP

(57) ABSTRACT

The invention relates to a device for dressing a grinding wheel, comprising a sleeve to hold a corundum rod laterally and to guide it along its longitudinal axis, a ram to apply constant thrust force onto the corundum rod held in place and guided in the sleeve, to bring it into contact with the grinding wheel, means of rigidly connecting the ram shaft to the end of the corundum rod, and linear guide means for the sleeve for translating the corundum rod parallel to the axis of the grinding wheel while keeping the rod pressed against the grinding wheel with a constant force.
Application to a centerless grinder in which the grinding wheel is used to grind nuclear fuel pellets.

15 Claims, 3 Drawing Sheets

(56) References Cited

U.S. PATENT DOCUMENTS

| | | | | |
|---|---|---|---|---|
| 3,576,189 | A | 4/1971 | Lorenz et al. | |
| 4,098,253 | A | 7/1978 | Bonnice | |
| 4,160,438 | A * | 7/1979 | Fujita | 125/11.06 |
| 4,167,081 | A | 9/1979 | Marmo | |
| 4,173,929 | A | 11/1979 | Fisher | |
| 4,182,082 | A | 1/1980 | Meyer | |
| 4,274,388 | A * | 6/1981 | Ivel | 125/11.06 |
| 4,339,896 | A * | 7/1982 | Dennis et al. | 51/298 |
| 4,434,583 | A | 3/1984 | Burgess, Jr. | |
| 4,700,936 | A | 10/1987 | Lunn | |
| 4,920,945 | A * | 5/1990 | Wedeniwski | 125/11.03 |
| 5,119,599 | A * | 6/1992 | Klipper et al. | 451/11 |
| 5,309,801 | A | 5/1994 | Markle | |
| 5,741,172 | A * | 4/1998 | Trionfetti et al. | 451/21 |
| 6,132,297 | A | 10/2000 | Couzy et al. | |
| 6,224,462 | B1 * | 5/2001 | Yokoyama et al. | 451/10 |
| 6,368,185 | B1 | 4/2002 | Glenville | |
| 6,729,948 | B2 | 5/2004 | Engelvin et al. | |
| 6,921,322 | B2 * | 7/2005 | Takata et al. | 451/252 |
| 7,223,038 | B2 | 5/2007 | Livingstone et al. | |
| 2002/0193057 | A1 | 12/2002 | Engelvin et al. | |
| 2007/0128986 | A1 * | 6/2007 | Imai et al. | 451/11 |
| 2011/0045739 | A1 * | 2/2011 | Keijzer et al. | 451/5 |
| 2013/0130602 | A1 | 5/2013 | Fantini et al. | |

FOREIGN PATENT DOCUMENTS

| | | | |
|---|---|---|---|
| EP | 0 960 837 | A1 | 12/1999 |
| EP | 1 021 272 | B1 | 11/2002 |
| EP | 1 264 661 | A1 | 12/2002 |
| EP | 1 834 729 | A1 | 9/2007 |
| JP | 1-81261 | U | 5/1989 |
| JP | 3-19756 | A | 1/1991 |
| JP | 3-117545 | A | 5/1991 |
| JP | 2001-205563 | A | 7/2001 |
| JP | 2003-53666 | A | 2/2003 |
| JP | 2009-6438 | A | 1/2009 |
| JP | 2010-155304 | A | 7/2010 |
| WO | 99/19114 | A1 | 4/1999 |
| WO | 2010/019774 | A2 | 2/2010 |
| WO | 2012/013634 | A1 | 2/2012 |

OTHER PUBLICATIONS

International Search Report and Written Opinion in International Application No. PCT/EP2011/062746, mailed Oct. 31, 2011.
Preliminary Search Report in French Patent Application No. 1056137, dated Mar. 16, 2011.
Preliminary Search Report in French Patent Application No. 1056138, dated Apr. 13, 2011.
Office Action in U.S. Appl. No. 13/812,861, mailed Oct. 30, 2014.
Office Action in Japanese Application No. 2013-521096, mailed Feb. 10, 2015.

* cited by examiner

DRESSING DEVICE FOR A GRINDING WHEEL AND ITS USE IN A CENTRELESS NUCLEAR FUEL PELLET GRINDER

CROSS-REFERENCE TO RELATED PATENT APPLICATION

The present application is a National Stage Application of International Application No. PCT/EP2011/062746 entitled "Device For Dressing A Grinding Wheel, And Use Thereof In A Centerless Grinder For Nuclear Fuel Pellets" filed Jul. 25, 2011, which claims priority of French Patent Application No. 1056137, filed Jul. 27, 2010, the contents of which are incorporated herein by reference in their entirety.

TECHNICAL FIELD

The invention relates to a device for dressing a grinding wheel, based on diamond grains.

It is intended more particularly to improve the efficiency and reliability of dressing.

It is used particularly in a centreless grinder in which the function of the grinding wheel is to grind the diameter of nuclear fuel pellets.

PRIOR ART

Centreless grinding is an advantageous grinding process for grinding cylindrical parts, particularly for nuclear fuel pellets.

A centreless grinder usually includes two grinding wheels, one of which is a drive wheel used to rotate the pellets on themselves and making them advance on a guide rail called the guide chute in the case of nuclear fuel pellets, and the other is a grinding wheel with the function of machining, in other words grinding the pellet diameter.

A grinding wheel usually comprises strips based on diamonds fixed by a metallic binder or a resin, around its periphery, that act as grinding elements. Three types of strips are used for grinding wheels for nuclear fuel pellets: one for rough machining, another for semi-finishing and the third for finishing the pellets.

The efficiency of machining of the grinding wheel depends on the condition of the diamonds and the clogging state of the wheel. The grinding wheel is sharpened by dressing using corundum rods.

Dressing is usually done by hand for grinding wheels in centreless grinders for nuclear fuel pellets. Thus an operator inserts a corundum rod with a tool through the access hatch at the back of a frame in which the grinder is located. The operator then attempts to position the corundum rod the best possible way, in other words as nearly as possible to the perpendicular to the grinding wheel. The operator then presses gently on the corundum rod manually to bring it into contact with the grinding wheel such that the rod applies a pressing force on the grinding wheel. While applying this force, the operator attempts to move the corundum rod to the best of his ability over the entire width of the grinding wheel. The operator may consume up to about ten corundum rods to perform a dressing operation considered to be satisfactory. This operation may introduce a serious risk for the operator, and risks of damaging the grinding wheel by breaking a corundum rod in the frame. The grinding wheel dressing tool was developed to prevent these risks and to improve dressing.

It would also be desirable to further improve the dressing quality of a grinding wheel.

Thus, the general purpose of the invention is to improve the dressing quality of the grinding wheel and therefore the ground parts, more particularly nuclear fuel pellets.

One particular purpose is to reduce risks incurred by an operator doing manual dressing according to the state of the art and the risks of damage to the grinding wheel.

PRESENTATION OF THE INVENTION

To achieve this, the purpose of the invention is a device for dressing a grinding wheel which, according to the invention, comprises essentially a sleeve to hold a corundum rod laterally and to guide it along its longitudinal axis, a ram to apply constant thrust force onto the corundum rod to bring it into contact with the grinding wheel, means of rigidly connecting the ram shaft to the end of a corundum rod, and linear guide means for the sleeve for translating the corundum rod parallel to the axis of the grinding wheel while keeping said rod pressed against the grinding wheel with a constant force.

Thus, the dressing device according to the invention minimises risks and makes dressing more efficient, more precise and more reliable. The dressing device according to the invention extends the life of a grinding wheel and improves the quality of parts ground by it such as nuclear fuel pellets.

According to one embodiment, the sleeve comprises a groove open at the top and with a U-shaped cross-section transverse to its longitudinal axis.

Advantageously, three guide rollers for the corundum rod are fitted in the sleeve approximately at the same longitudinal distance, two of the rollers being fitted facing each other on one leg of the U of the groove and the third being fitted at the top of the U of the groove, the dimensions of the space between the rollers and the bottom of the U of the groove corresponding to nominal transverse dimensions of the corundum rod. The rollers thus facilitate guidance of the corundum rod, reduce friction and perform an anti-vibration function of the corundum rod in the sleeve.

The ram is preferably a double-acting ram, so that it can also control the distance of the corundum rod from the grinding wheel.

The ram is preferably a pneumatic ram regulated by a pressure reducer. The pressure of a regulated pneumatic ram guarantees efficient dressing without too much pressure on the grinding wheel to be dressed.

The linear guidance means are preferably composed of rails that function dry. Thus in a glove box environment, linear dry type guidance avoids the need for the presence of a moderator in the glove box, in other words it avoids the need for an additional risk of criticality and prevents pollution of parts to be ground such as nuclear fuel pellets, by said moderator.

The device according to the invention may comprise two limit stops of the linear guide means to limit the displacement of the corundum rod to the width of the grinding wheel.

The device advantageously comprises a carriage in two parts pivoting relative to each other, the lower part of the carriage being permanently guided by the linear guidance means, the upper part of the carriage pivoting between a rest position in which the sleeve is approximately parallel to the centre line of the grinding wheel and a dressing position in which the sleeve is approximately perpendicular to the axis of the grinding wheel.

The invention may also comprise a manual locking lever for pivoting the upper part of the carriage.

The invention also relates to a dressing assembly that will be used for dressing a grinding wheel, comprising a corundum rod and a part, one end of the part being moulded onto the corundum rod, the other end of the part comprising a groove forming a mortise adapted to house the shaft of the ram of the device described above, forming a tenon and making a dovetail assembly between the tenon and the mortise. Thus, with the corundum rod and the ram fixed to each other in this manner, the distance of the corundum rod from the grinding wheel can be adjusted by the double acting ram.

The part may comprise a gripping pin to facilitate manual insertion of the corundum rod into the sleeve when it is new and to remove it manually when it is worn.

The invention also relates to a centreless grinder for parts comprising a drive wheel to advance the parts and a grinding wheel arranged facing the drive wheel to grind said parts and a dressing device for the grinding wheel described above and located close to the grinding wheel and facing it opposite the drive wheel.

The centreless grinder is ideally suited for grinding of nuclear fuel pellets.

BRIEF DESCRIPTION OF THE DRAWINGS

Other advantages and characteristics will become clear after reading the detailed description given below with reference to the following drawings among which.

DETAILED PRESENTATION OF PARTICULAR EMBODIMENTS

Figure 1:
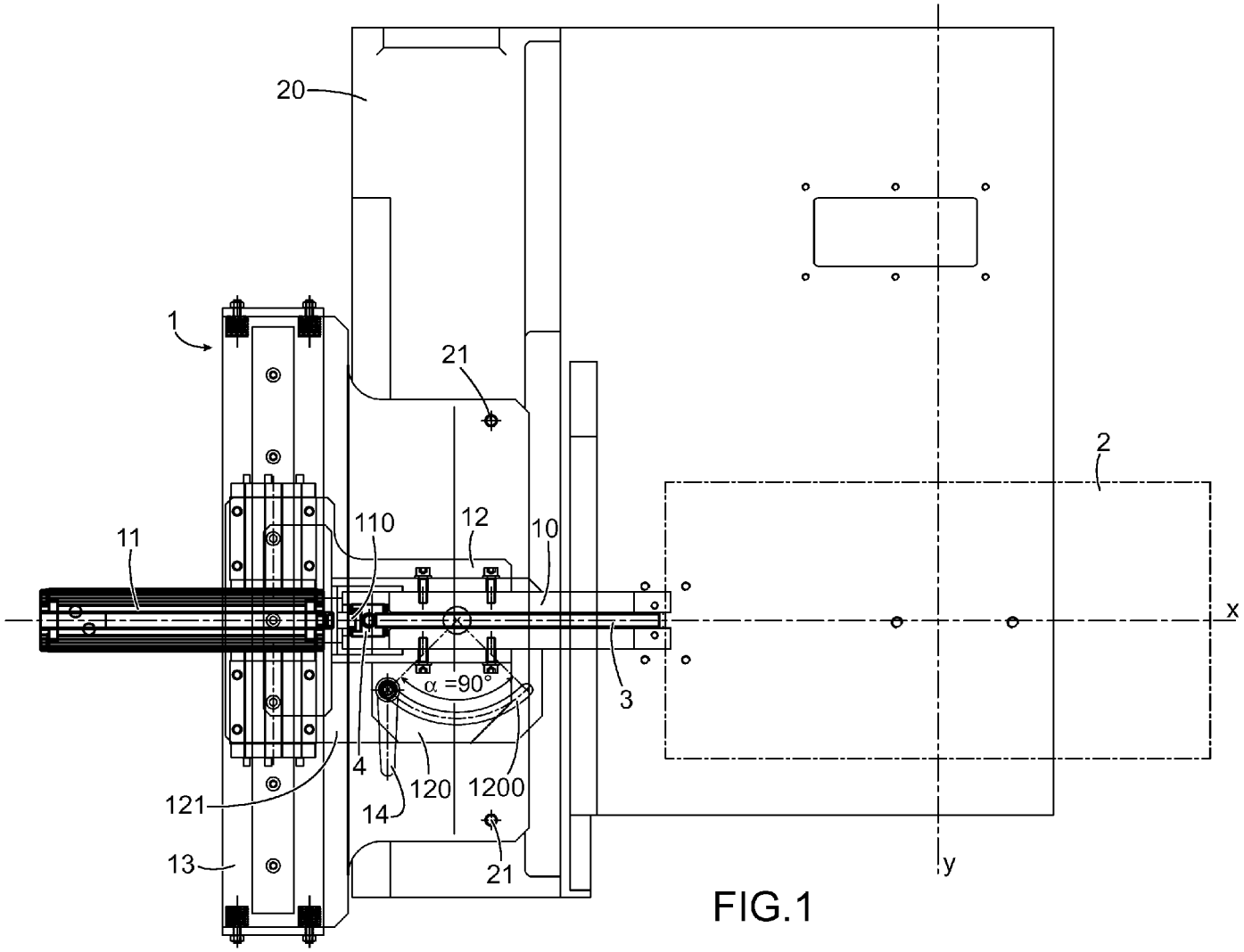
FIG. 1 shows a top view of a dressing device according to the invention in a configuration installed close to a grinding wheel to be dressed with a fixed corundum rod.

The terms "lower", "upper", "below" and "above" shall be considered in the installed configuration of the dressing device 1 and a corundum rod, in other words with the corundum rod approximately horizontal.

The dressing device 1 according to the invention is shown in its configuration installed close to a grinding wheel 2 to be sharpened.

As shown, the device 1 is fixed by screws 21 to the frame 20 supporting the grinding wheel.

The dressing device 1 comprises firstly a sleeve 10 to hold a corundum rod 3 in position laterally and guide it along its longitudinal X axis.

As shown, the sleeve 10 comprises a groove opened at the top and with a U shaped cross section transverse to its longitudinal axis.

Figures 2, 2A, 2B:
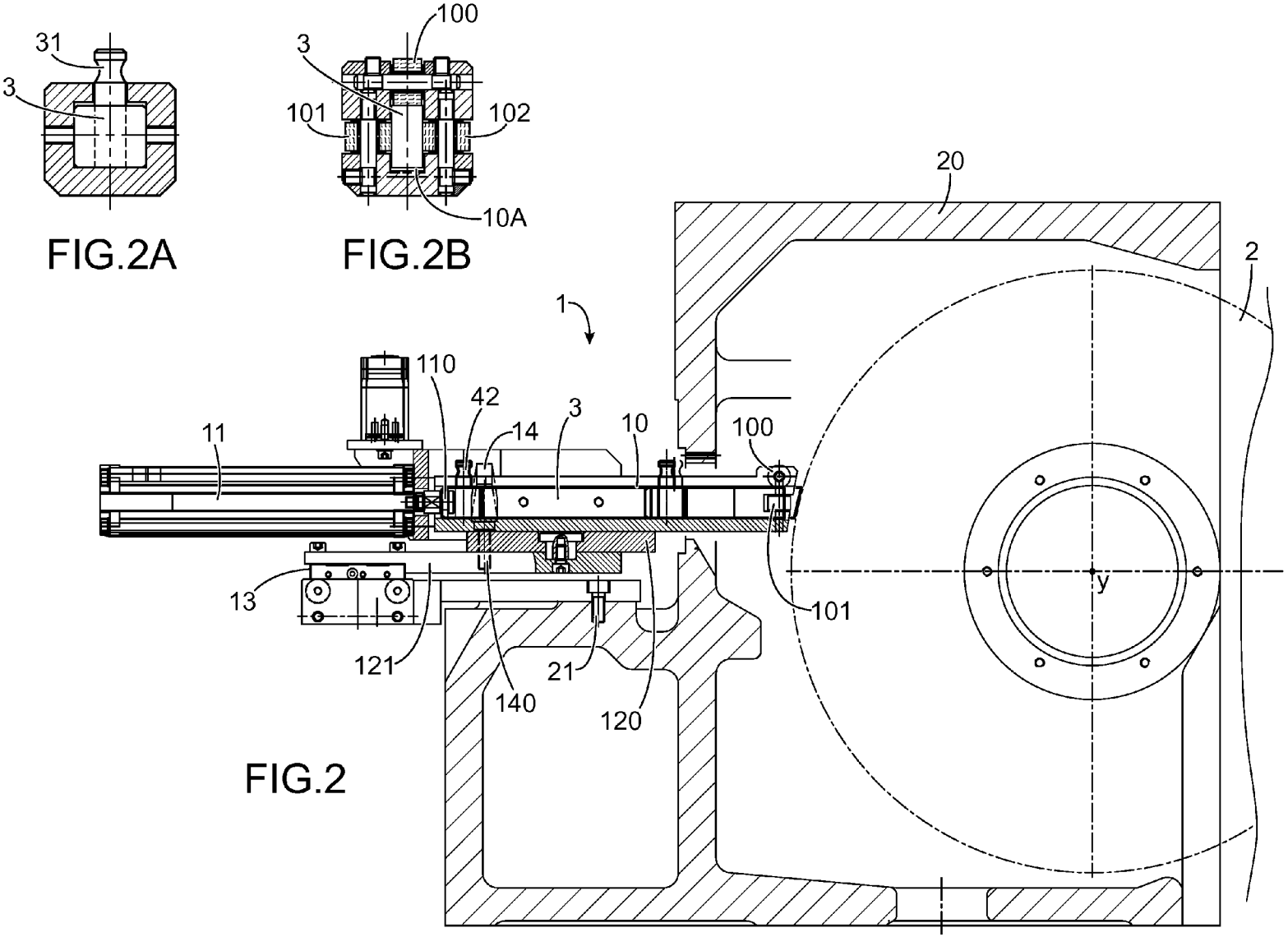
FIG. 2 is a longitudinal sectional view of the device according to FIG. 1, FIGS. 2A and 2B are detailed views of FIG. 2.

As can be seen in FIG. 2B, three guide rollers 100, 101, 102 of the corundum rod 3 are installed in the sleeve 10 approximately at the same longitudinal dimension, at its end closest to the grinding wheel 2 to be sharpened. More precisely, one roller 100 is installed on the top of the U of the groove of the sleeve and each of the other two rollers 101, 102 is fitted on one leg of the U of the groove, these two rollers facing each other. The dimensions of the space thus defined between the rollers 100, 101, 102 and the bottom 10 A of the U of the groove corresponds to the nominal transverse dimensions of the corundum rod 3 (FIG. 2B).

The device 1 also comprises a double acting pneumatic ram 11 to apply a constant thrust force to the corundum rod 3 held in place and guided in the sleeve 10 in contact with the grinding wheel 2.

The ram shaft 110 is fixed to the corundum rod 3 using a tenon/mortise system. More precisely, an intermediate fixing part 4 is provided between the corundum rod 3 and the shaft of the ram 11. As shown more clearly in FIG. 3, one end 40 of the part 4 is moulded onto the corundum rod 3. This part 4 comprises a groove 41 at the other of its ends, forming a mortise adapted to house the ram shaft 110 forming a tenon and forming a dovetail assembly between the tenon and the mortise. The intermediate part 4 also comprises a gripping pin 42 that is used for manual insertion of a new corundum rod 3 into the sleeve 10 and for removing it when it is worn.

The sleeve 10 and the double acting ram 11 are installed on the upper part 120 of a carriage 12.

This carriage 12 is in two parts 120, 121 that pivot relative to each other. The lower part 121 of the carriage is mounted free to slide permanently on the linear guide rails 13 that are parallel to the Y axis of the grinding wheel 2. The linear guiding system displaces the sleeve 10 over the entire width of the grinding wheel 2 without changing the distance between the sleeve 10 in the dressing position and the grinding wheel 2. The guidance done by the rails is preferably dry, when dressing is done in a strictly controlled environment such as a glove box in a centreless grinder for nuclear fuel pellets; this thus avoids the presence of a moderator in the glove box (a risk of criticality) and pollution of pellets.

Figure 3:
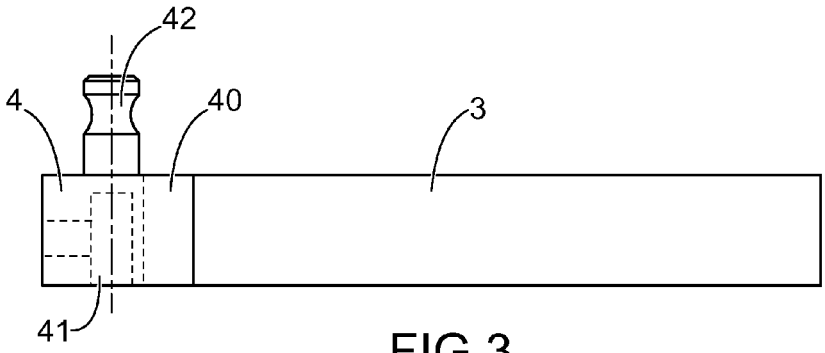
FIG. 3 shows a dressing device with a corundum rod according to the invention.

The upper part 120 of the carriage 12 is free to pivot between a rest position in which the sleeve 10 is approximately parallel to the Y axis of the grinding wheel 2 and a dressing position as shown in FIGS. 1, 2, 3 in which the sleeve 10 is approximately perpendicular to the axis of the grinding wheel 2. Thus, in the embodiment shown, the sleeve 10 can pivot by an angle of 90°.

In other words with the dressing device, the tool part of the dressing device consisting of the sleeve 10 and the double acting ram 11 can be put into two positions:

- the rest position, in which the X axis of the sleeve and the Y axis of the grinding wheel 2 are parallel; this position is used when changing worn corundum rods,
- the dressing position, in which the X axis of the sleeve and the Y axis of the grinding wheel 2 are perpendicular.

Pivoting between the two parts 120, 121 of the carriage 12 is locked by tightening a locking lever 14. This locking lever 14 comprises a screw 140 fixed on the upper part 120 of the carriage 12 and an indexable handle 141 that holds the tool part 10, 11 in position in each of the two positions (rest and dressing). The tool part 10, 11 pivots by loosening the locking lever 14 and therefore the screw 140 and then by the screw 140 sliding in an opening 1200 formed on the upper part 120 of the carriage 12. The opening 1200 has an angular length of 90°, which enables the tool part 10, 11 to rotate from 0° (rest position) to 90° (dressing position).

Thus, with the guide rails 13 arranged parallel to the Y axis of the grinding wheel 2 and the tool part 10, 11 pivoted into its dressing position, the sleeve 10 is guided linearly perpendicularly to the grinding wheel over its entire width; the corundum rod 3 is actually moved parallel to the grinding wheel and is held pressed against it by the ram with a constant force during a dressing operation.

Screws not described are fixed on each side of the lower carriage 121 and their function is to adjust the displacement of the tool part 10, 11 of the device 1 relative to the grinding wheel 2, which guarantees that a corundum rod 3 does not project beyond the edge of the grinding wheel 2 to be sharpened.

FIG. 3 shows a dressing assembly composed prior to its assembling into the tool part 10, 11 and prior to the dressing operation itself; this assembly comprises a corundum rod 3 and the part 4 in which the rod 3 is adjusted with clamping to the end 40. This part 4 may be moulded onto the corundum rod 3. This part 4 comprises a groove 41 at its other end to fix it to the shaft 110 of the ram 11 using the tenon/mortise assembly described above. Finally, a gripping pin 42 is provided to enable manual insertion of a new corundum rod into the groove of the sleeve 10 and to remove it when it is worn. The pin 42 may for example be force fitted and glued into the part 4.

Figure 4:
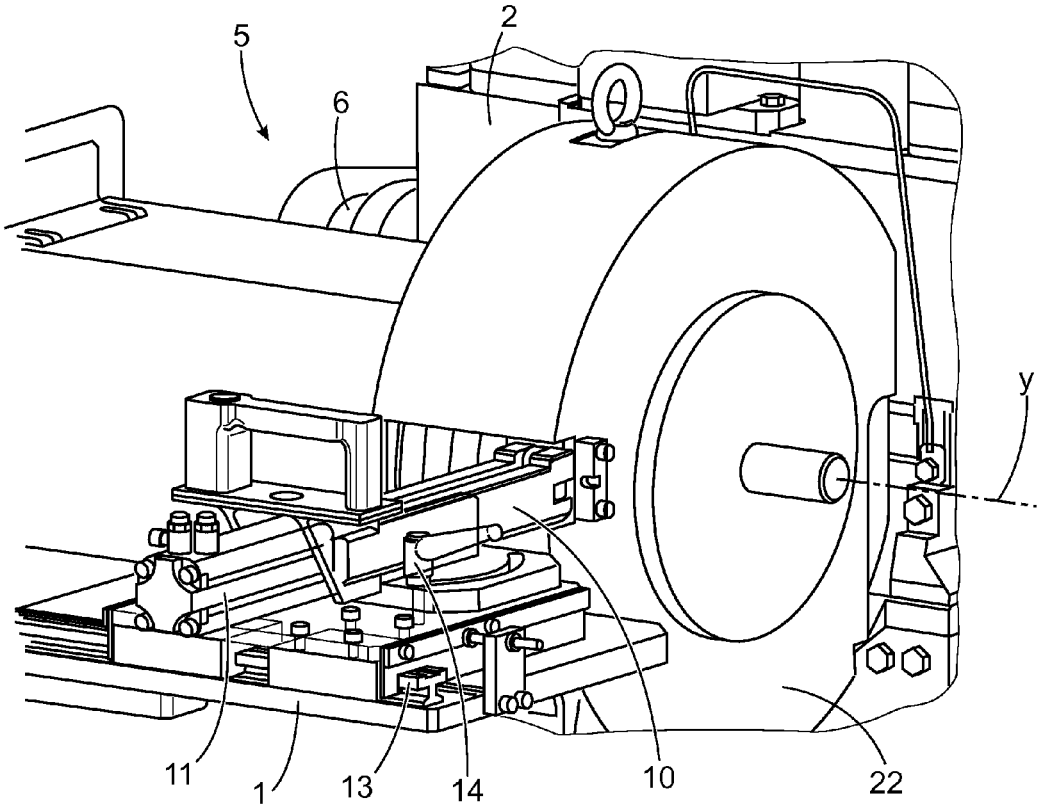
FIG. 4 is a perspective view of a dressing device according to the invention installed in a centreless grinder for nuclear fuel pellets in a glove box.

FIG. 4 shows a perspective view of a dressing device 1 according to the invention as it is placed in a centreless grinder 5 for nuclear fuel pellets, itself located in a glove box. More precisely, the centreless grinder 5 comprises a drive wheel 6 to move the pellets forwards by rotation on themselves and a grinding wheel 2 fitted facing the drive wheel to grind the nuclear fuel pellets. The dressing device 1 according to the invention is arranged close to the grinding wheel 2 and facing it opposite the drive wheel 6.

In this case the grinding wheel 2 is confined by a cover 22. The glove box comprises an access hatch (not shown) that is usually designed to provide access to the grinding wheel. The dressing device 1 is arranged in front of the grinding wheel access window; an operator with his hands in the gloves of the glove box can thus access the tool part 10, 11 of the device or any other element of it, through the door to the manual locking lever 14.

Although the description is given with reference to an application in a centreless grinder for grinding nuclear fuel pellets, the dressing device could be used for any application requiring reliable and efficient dressing of grinding wheels.

The device according to the invention that has just been described can also use materials other than corundum to sharpen the grinding wheels. It may be any material with a hardness equivalent to corundum and that can be used to sharpen a wheel based on diamond grains, such as aluminium oxide, silicon carbide or a quartz-based abrasive.

The invention claimed is:

1. Device for dressing a grinding wheel, comprising:

a sleeve configured to hold a corundum rod laterally and to guide the corundum rod along the longitudinal axis of the sleeve, a ram configured to apply a constant thrust force to the corundum rod while holding the corundum rod in the sleeve and guiding the corundum rod in the sleeve so that the corundum rod is in contact with the grinding wheel, wherein the ram comprises a ram shaft, a part for detachably connecting the ram shaft to an end of the corundum rod, wherein the part comprises a first end being moulded onto the corundum rod and a second end opposite to the first end along the longitudinal axis of the sleeve, wherein the shaft of the ram forms tenon, wherein the second end comprises a groove forming a mortise adapted to house the shaft of the ram, linear guiding rails configured to translate both the corundum rod and the sleeve parallel to the axis of the grinding wheel while keeping the corundum rod pressed against the grinding wheel with a constant force.

2. Device for dressing a grinding wheel according to claim 1, wherein the shaft of the ram and the groove are configured to make a dovetail assembly.

3. Device for dressing a grinding wheel according to claim 2, comprising three guide rollers for guiding the corundum rod, wherein the guide rollers are fitted in the sleeve approximately at the same distance along the longitudinal axis of the sleeve, wherein two of the rollers are fitted facing each other wherein the two rollers are fitted on one leg of the U of the groove and wherein the third roller is fitted at the top of the groove, wherein the dimensions of the space between the rollers and the bottom of the U of the groove correspond to nominal transverse dimensions of the corundum rod.

4. Device for dressing a grinding wheel according to claim 1, in which the ram is a double-acting ram, configured to move the corundum rod toward from the grinding wheel and configured to move the corundum rod away from the grinding wheel.

5. Device for dressing a grinding wheel according to claim 1, in which the ram is a pneumatic ram wherein a pressure reducer is configured to regulate the pressure in the ram.

6. Device for dressing a grinding wheel according to claim 1, comprising two limits stoppers for the linear guiding rails, wherein the limit stoppers are configured to limit the displacement of the corundum rod relative to the width of the grinding wheel.

7. Device for dressing a grinding wheel according to claim 1, further comprising a carriage comprising on upper part and a lower part wherein the two parts are configured to pivot relative to each other, wherein the lower part of the carriage being is configured to be permanently guided by the linear, guiding rail, and wherein the upper part of the carriage is configured to pivot between a rest position in which the sleeve is approximately parallel to the centre line of the grinding wheel and a dressing position in which the sleeve is approximately perpendicular to the axis of the grinding wheel.

8. Device for dressing a grinding wheel according to claim 7, comprising a manual locking lever configured to pivot the upper part of the carriage.

9. Device for dressing a grinding wheel according to claim 1, wherein the longitudinal axis of the sleeve is substantially orthogonal to the axis of the grinding wheel.

10. Device for dressing a grinding wheel according to claim 1, wherein the sleeve comprises a groove open at the top of the sleeve, and wherein the groove has a U-shaped cross-section transverse to the longitudinal axis of the sleeve.

11. Dressing assembly for dressing a grinding wheel, comprising:

a corundum rod, and a part for detachably connecting a shaft of a ram to an end of the corundum rod, wherein the ram is configured to apply a constant thrust force to the corundum rod while holding the corundum rod in the sleeve and guiding the corundum rod in the sleeve so that the corundum rod is in contact with the grinding wheel, wherein the part comprises a first end being moulded onto the corundum rod and a second end opposite to the first end along the longitudinal axis of the sleeve, wherein the shaft of the ram forms a tenon and wherein the second end comprises a groove forming a mortise adapted to house the shaft of the ram.

12. Dressing assembly according to claim 10, in which the part comprises a gripping pin configured to be held manually.

13. Dressing assembly according to claim 11, wherein the shaft of the ram and the groove are configured to make a dovetail assembly.

14. Centreless grinder, comprising:

a drive wheel to move the parts to be grinded towards a grinding wheel, a grinding wheel facing the drive wheel, and a device for dressing the grinding wheel, comprising:

a sleeve configured to hold a corundum rod laterally and to guide the corundum rod along the longitudinal axis of the sleeve, a ram configured to apply a constant thrust force to the corundum rod, while holding the corundum rod in the sleeve and guiding the corundum rod in the sleeve so that the corundum rod is in contact with the grinding wheel, wherein the ram comprises a ram shaft, a part for detachably connecting the ram shaft to an end of the corundum rod, wherein the part comprises a first end being moulded onto the corundum rod and a second end opposite to the first end along the longitudinal axis of the sleeve, wherein the shaft of the ram forms a tenon, wherein the second end comprises a groove forming a mortise adapted to house the shaft of the ram, linear guiding rails configured to translate both the corundum rod and the sleeve parallel to the axis of the grinding wheel while keeping the corundum rod pressed against the grinding wheel with a constant force, wherein the device for dressing the grinding wheel is located close to the grinding wheel and faces the grinding wheel and wherein the device for dressing the grinding wheel is located opposite the drive wheel relative to the grinding wheel.

15. Centreless grinder according to claim 14, wherein the grinding wheel is configured to grind nuclear fuel pellets.

* * * * *